US011147421B2

(12) United States Patent
Lee et al.

(10) Patent No.: US 11,147,421 B2
(45) Date of Patent: Oct. 19, 2021

(54) HANDY-STICK TYPE VACUUM CLEANER

(71) Applicant: Samsung Electronics Co., Ltd., Suwon-si (KR)

(72) Inventors: Dong-hyun Lee, Hwaseong-si (KR); Dong-hun Yoo, Suwon-si (KR); Tae-woon Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 14 days.

(21) Appl. No.: 16/618,929

(22) PCT Filed: Jul. 13, 2018

(86) PCT No.: PCT/KR2018/007966
§ 371 (c)(1),
(2) Date: Dec. 3, 2019

(87) PCT Pub. No.: WO2019/031719
PCT Pub. Date: Feb. 14, 2019

(65) Prior Publication Data

US 2020/0138254 A1 May 7, 2020

(30) Foreign Application Priority Data

Aug. 9, 2017 (KR) ..... 10-2017-0100837

(51) Int. Cl.
*A47L 5/22* (2006.01)
*A47L 5/24* (2006.01)
(Continued)

(52) U.S. Cl.
CPC ..... *A47L 5/225* (2013.01); *A47L 5/24* (2013.01); *A47L 9/248* (2013.01); *A47L 9/322* (2013.01); *A47L 9/327* (2013.01)

(58) Field of Classification Search
CPC ..... A47L 9/242; A47L 9/322; A47L 9/1675; A47L 9/32; A47L 9/327; A47L 9/16;
(Continued)

(56) References Cited

U.S. PATENT DOCUMENTS 6,714,750 B2 3/2004 Terada et al.
7,854,039 B2 12/2010 Lee et al.
(Continued)

FOREIGN PATENT DOCUMENTS

AU 2015101730 A4 1/2016
CN 101243959 A 8/2008
(Continued)

OTHER PUBLICATIONS

STIC Search Report (Year: 2021).*
(Continued)

*Primary Examiner* — Joseph J Hail
*Assistant Examiner* — Michael A Gump
(74) *Attorney, Agent, or Firm* — Jefferson IP Law, LLP

(57) ABSTRACT

A handy-stick type vacuum cleaner is disclosed. The disclosed vacuum cleaner can comprise: a first part including a dust collection unit; a second part including a suction motor and a handle; a third part for connecting the first and second parts such that the first and second parts rotate with each other; and a mode setting unit disposed inside the second part so as to selectively lock and unlock the third part, thereby setting a rotating mode enabling the first and second parts to rotate with each other and a fixing mode disabling the rotation thereof.

13 Claims, 22 Drawing Sheets

(51) Int. Cl.
*A47L 9/24* (2006.01)
*A47L 9/32* (2006.01)

(58) Field of Classification Search
CPC .... A47L 9/1608; A47L 9/1616; A47L 9/1625; A47L 9/1633; A47L 9/1641; A47L 9/165; A47L 9/1658; A47L 9/1666; A47L 9/1683; A47L 9/1691; A47L 9/12; A47L 5/24; A47L 5/22; A47L 5/225; A47L 11/40
USPC ..... 15/143.1, 300.1, 345, 344
See application file for complete search history.

(56) References Cited

U.S. PATENT DOCUMENTS

| | | | | |
|---|---|---|---|---|
| 8,028,373 | B2 | 10/2011 | Rowntree | |
| 8,813,297 | B2 | 8/2014 | Rosenzweig et al. | |
| 8,918,952 | B2 | 12/2014 | Rowntree | |
| 2004/0177461 | A1 | 9/2004 | Ajluni | |
| 2007/0033765 | A1* | 2/2007 | Walker | A47L 9/2873 15/344 |
| 2008/0022483 | A1 | 1/2008 | Potoroka | |
| 2009/0019663 | A1 | 1/2009 | Rowntree | |
| 2011/0219557 | A1* | 9/2011 | Rosenzweig | A47L 5/28 15/144.1 |
| 2011/0308038 | A1 | 12/2011 | Rowntree | |
| 2012/0079671 | A1 | 4/2012 | Stickney et al. | |
| 2014/0082882 | A1 | 3/2014 | Kawamata et al. | |
| 2014/0237767 | A1 | 8/2014 | Conrad | |
| 2016/0287042 | A1* | 10/2016 | Han | A47L 9/1683 |
| 2017/0112343 | A1* | 4/2017 | Innes | A47L 9/24 |
| 2017/0209011 | A1* | 7/2017 | Robinson | A47L 9/102 |
| 2017/0319025 | A1* | 11/2017 | Hu | A47L 5/00 |
| 2018/0132683 | A1* | 5/2018 | Walker | A47L 9/0054 |
| 2019/0059672 | A1* | 2/2019 | Zhang | A47L 9/244 |
| 2019/0328188 | A1* | 10/2019 | Conrad | A47L 9/1608 |
| 2019/0343356 | A1* | 11/2019 | Kim | A47L 9/2884 |

FOREIGN PATENT DOCUMENTS

| | | | | |
|---|---|---|---|---|
| CN | 201398934 | Y | | 2/2010 |
| CN | 202020379 | U | | 11/2011 |
| CN | 102440717 | A | | 5/2012 |
| CN | 106618375 | A | | 5/2017 |
| JP | 10-2005-176873 | A | | 7/2005 |
| JP | 2005270312 | A | * | 10/2005 |
| JP | 2014-068673 | A | | 4/2014 |
| KR | 10-1995-0005262 | A | | 3/1995 |
| KR | 10-0136326 | B1 | | 7/1997 |
| KR | 10-2000-0011948 | A | | 2/2000 |
| KR | 10-0448183 | B1 | | 9/2004 |
| KR | 10-0476349 | B1 | | 3/2005 |
| KR | 10-0607974 | B1 | | 8/2006 |
| KR | 10-2007-0037179 | A | | 4/2007 |
| KR | 10-0762323 | B1 | | 10/2007 |
| KR | 10-1193779 | B1 | | 10/2012 |
| KR | 10-1213369 | B1 | | 12/2012 |
| KR | 10-1462952 | B1 | | 11/2014 |
| KR | 10-2016-0089948 | A | | 7/2016 |
| WO | 2018/128371 | A1 | | 7/2018 |

OTHER PUBLICATIONS

Ohinese Office Action dated Dec. 1, 2020, issued in Chinese Application No. 201880047760.4.
Extended European Search Report dated Aug. 20, 2020, issued in European Patent Application No. 18844294.1.
Korean Office Action with English translation dated Jul. 29, 2021; Korean Appln. No. 10-2017-0100837.

* cited by examiner

HANDY-STICK TYPE VACUUM CLEANER

CROSS-REFERENCE TO RELATED APPLICATION(S)

This application is a U.S. National Stage application under 35 U.S.C. § 371 of an International application number PCT/KR2018/007966, filed on Jul. 13, 2018, which is based on and claimed priority of a Korean patent application number 10-2017-0100837, filed on Aug. 9, 2017, in the Korean Intellectual Property Office, the disclosure of which is incorporated by reference herein in its entirety.

TECHNICAL FIELD

The disclosure relates to a cleaner, and more particularly, to a handy-stick type vacuum cleaner that may be used in a stick type by combining an extension tube and a brush with each other, or used in a handy type by separating an accessory.

BACKGROUND ART

In general, handy type, stick type, and handy-stick type vacuum cleaners are manufactured to be smaller than canister and upright type vacuum cleaners and have a light weight, such vacuum cleaners are easy to handle. In addition, such vacuum cleaners are often wireless vacuum cleaners because they have a rechargeable battery to supply power on their own.

As described above, the wireless vacuum cleaner may more easily clean not only a floor surface (e.g., a floor) but also a window frame, a bookcase, a sofa, and the like than a wired vacuum cleaner.

In this case, the posture and direction of the user's hand, wrist and arm need to be changed according to the place and location where the vacuum cleaner sucks the dust.

That is, since the handle is fixed to the body, the user often needs to use the vacuum cleaner by twisting his/her wrist or arm in order to clean in the desired direction. As a result, a large load is applied to the wrist or the arm during cleaning, and the user easily feels fatigue, and in particularly, if a surface to be cleaned is not a general floor but a window frame, a sofa, a ceiling, and the like, there is a problem that the fatigue of the wrist is further increased.

DISCLOSURE

Technical Problem

The disclosure provides a handy-stick type vacuum cleaner that may selectively adjust an angle of a handle so that a user may clean in a comfortable posture without bending or twisting a wrist or an arm at a predetermined angle.

Technical Solution

According to an embodiment of the disclosure, a handy-stick type vacuum cleaner includes a first part configured to include a dust collection unit; a second part configured to include a suction motor and a handle; a third part configured to rotatably connect the first and second parts with each other; and a mode setting unit configured to be disposed inside the second part to selectively lock and unlock the third part, and set a rotating mode in which the first and second parts are rotated with respect to each other and a fixing mode in which the first and second parts are not rotated.

The third part may include a first connection member coupled to the first part; and a second connection member coupled to the second part and rotatably connected to the first connection member.

The mode setting unit may include a locking protrusion moving to any one of a locked position and an unlocked position for locking and unlocking the first connection member, and the first connection member may include an engaging protrusion that interferes with the locking protrusion at the locked position.

The mode setting unit may include a button having a portion protruding externally from the second part; a holder fixed to the inside of the second part; and a latch having one side coupled to the button and the other side movably connected to the holder, and formed integrally with the locking protrusion.

An elastic member for elastically supporting the latch may be disposed inside the holder.

Each of the locking protrusion and the engaging protrusion may have one side surface disposed in a direction facing each other in the fixing mode and the other side surface disposed on an opposite side to the one side surface, and at least one of the other side surface of the locking protrusion or the other side surface of the engaging protrusion is formed to be inclined.

The second part may be formed with the handle and the button may be disposed at a position adjacent to the handle.

The second connection member may be formed with an accommodation space in which a rear of the first connection member is rotatably accommodated, and the locking protrusion may be led into the accommodation space to interfere with the engaging protrusion of the first connection member.

In the fixing mode, an axis of the first part in a length direction and an axis of the second part in a length direction may be in parallel to each other, and in the rotating mode, the axis of the first part in the length direction and the axis of the second part in the length direction may form an obtuse angle.

The first and second parts may communicate with each other through a flexible tube.

The flexible tube may be disposed inside the third part.

An angle at which the first part is rotatable with respect to the second part may be an acute or obtuse angle.

According to another embodiment of the disclosure, a handy-stick type vacuum cleaner includes a first part configured to including a dust collection unit having a suction hole formed in a tip thereof and detachably mounted in a mounting space communicating with the suction hole; a second part configured to have a suction motor disposed inside thereof and a handle extending to one side thereof, and communicate with the first part through a flexible tube; a third part configured to include a first connection member coupled to a rear of the first part and a second connection member coupled to a front of the second part and rotatably connected to the first connection member by a rotation shaft; and a mode setting unit configured to set a rotating mode in which the first part is rotated and a fixing mode in which the first part is not rotated by selectively locking and unlocking the first part.

The mode setting unit may be elastically disposed in a state movable inside the second part, have a portion protruding externally from the second part, and interfere with a portion of the first part in the fixing mode.

The mode setting unit may include a locking protrusion for locking and unlocking an engaging protrusion of the first part, each of the locking protrusion and the engaging protrusion may have one side surface disposed in a direction facing each other in the fixing mode and the other side surface disposed to be inclined on an opposite side to the one side surface, and the other side surfaces of the locking protrusion and the engaging protrusion may be inclined in a direction facing each other.

BEST MODE

In order to fully understand the constitution and effects of the disclosure, embodiments of the disclosure will be described with reference to the accompanying drawings. However, the disclosure is not limited to embodiments disclosed below, but may be implemented in various forms and may be variously modified. However, the description of the embodiments is provided only to make the disclosure complete, and to fully inform the scope of the disclosure to those skilled in the art. In the accompanying drawings, for convenience of description, the size of the components is shown to be larger than the actual size, and the ratio of each component may be exaggerated or reduced.

Terms such as first and second may be used to describe various components, but the components should not be limited by the terms. The terms may be used only for the purpose of distinguishing one component from another component. For example, without departing from the scope of the disclosure, a first component may be referred to as a second component, and similarly, the second component may also be referred to as the first component.

Unless otherwise defined, terms used in the embodiments of the disclosure may be interpreted as meanings commonly known to those skilled in the art.

Hereinafter, a structure of a handy-stick type vacuum cleaner according to an embodiment of the disclosure will be described in detail with reference to the accompanying drawings.

Figure 1:
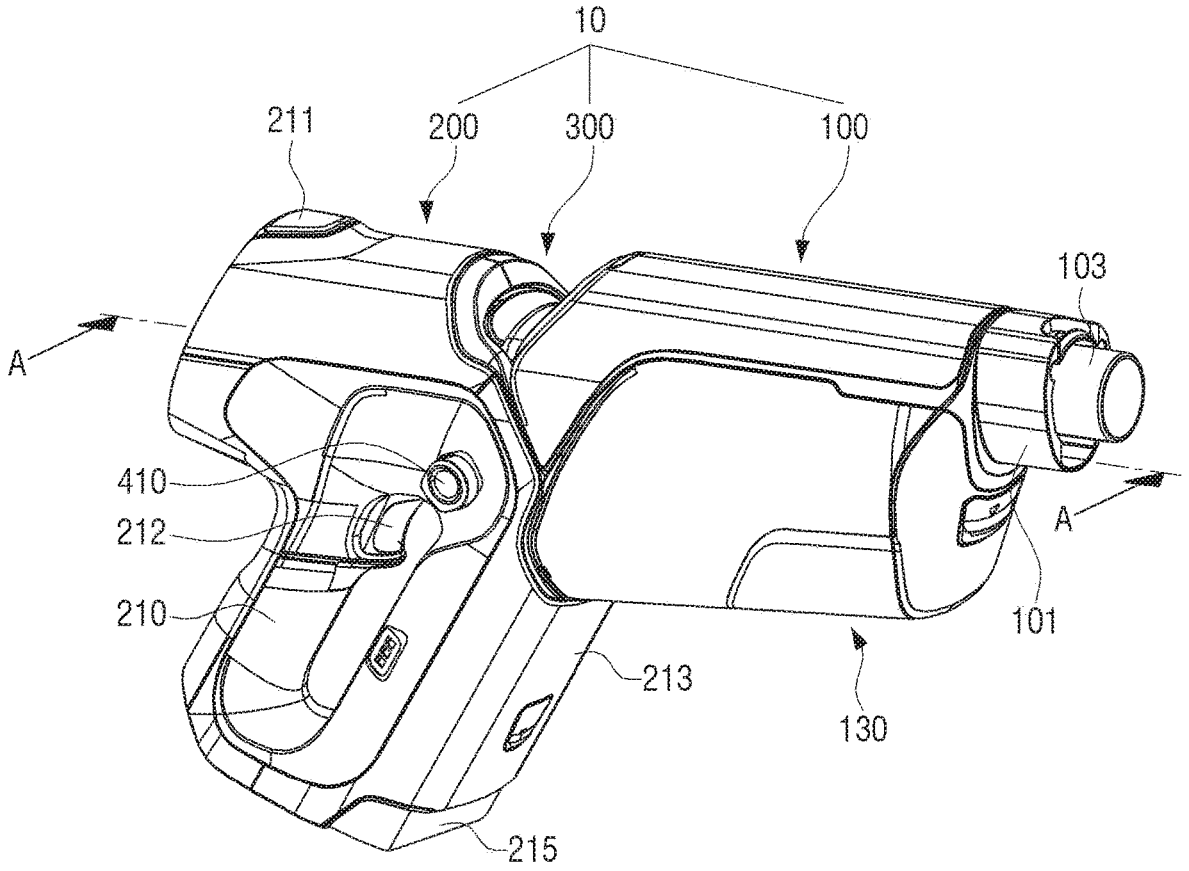
FIG. 1 is a perspective view illustrating a handy-stick type vacuum cleaner according to an embodiment of the disclosure.

FIG. 1 is a perspective view illustrating a handy-stick type vacuum cleaner according to an embodiment of the disclosure.

Referring to FIG. 1, a handy-stick type vacuum cleaner 10 according to an embodiment of the disclosure includes a first part 100 having a dust collection unit 130, a second part 200 having a handle 210 and a suction motor 250, a third part 300 rotatably connecting the first and second parts 100 and 200 with each other, and a mode setting unit 400 capable of setting a fixing mode in which the first and second parts 100 and 200 are not rotated and a rotating mode in which the first and second parts 100 and 200 are rotated with respect to each other.

Figure 2:
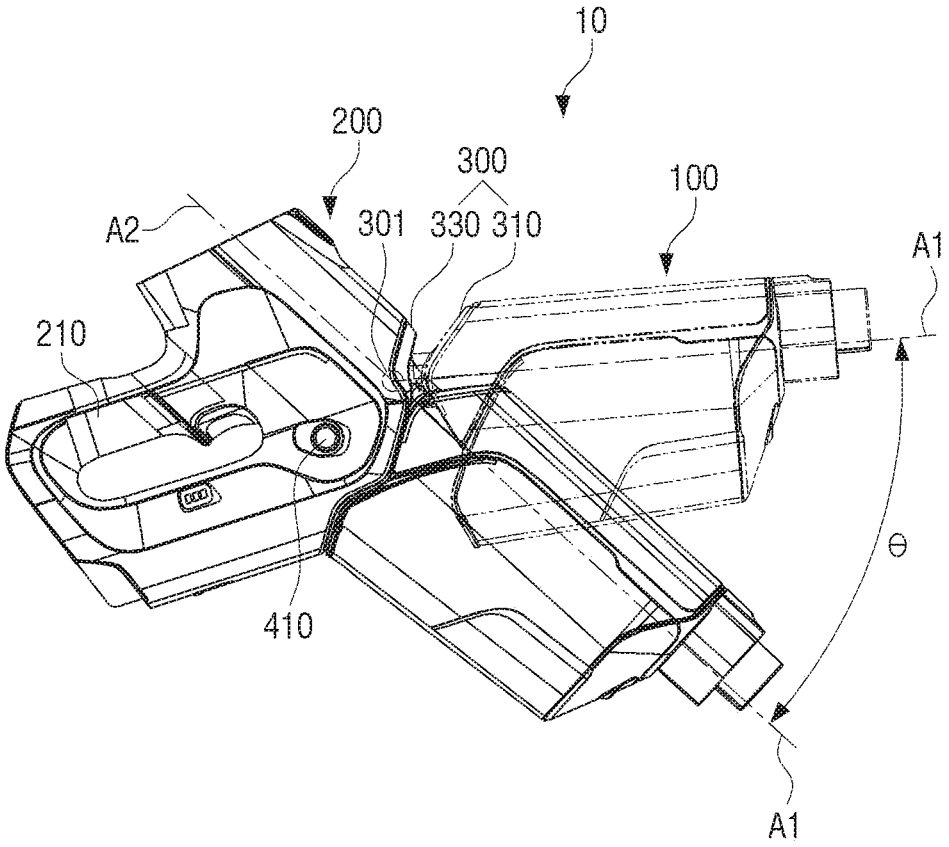
FIG. 2 is a view illustrating a state in which a first part of the handy-stick vacuum cleaner according to an embodiment of the disclosure rotates with respect to a second part relative to a third part.

FIG. 2 is a view illustrating a state in which a first part of the handy-stick vacuum cleaner according to an embodiment of the disclosure rotates with respect to a second part relative to a third part.

Referring to FIG. 2, the third part 300 has a first connection member 310 coupled to the first part 100 and a second connection member 330 coupled to the second part 200. The first and second connection members 310 and 330 rotate with respect to a rotation shaft 301. The rotation shaft 301 may be formed by a pair of coupling holes 311 (see FIG. 7) of the first connection member 310 and a pair of shaft protrusions 331 (see FIG. 7) of the second connection member 330, which are rotatably inserted into the pair of coupling holes 311, respectively.

The fixing mode is a state in which the third part 300 is locked by the mode setting unit 400. In the fixing mode, a first axis A1 of the first part 100 in a length direction and a second axis A2 of the second part 200 in a length direction may be disposed coaxially or disposed parallel to each other.

The rotating mode of the handy-stick type vacuum cleaner 10 is a state in which third part 300 is unlocked by the mode setting unit 400. In the rotating mode, the first axis A1 and the second axis A2 may form a predetermined angle θ. In this case, the first part 100 may rotate about the rotation shaft 301 of the third part 300 with respect to the second part 200 within the predetermined angle θ.

In FIG. 2, the angle θ at which the first part 100 may rotate with respect to the second part 200 is illustrated to correspond to a substantially acute angle, but is not limited thereto, and the handy-stick type vacuum cleaner 10 may also be manufactured such that the angle θ corresponds to an obtuse angle. To this end, it may also be considered to form a longer length of a flexible tube 500 (see FIG. 5) that interconnects the interiors of the first and second parts 100 and 200.

Switching from the fixing mode to the rotating mode is performed by unlocking the third part 300 by pressing a button 410 of the mode setting unit 400 exposed to the outside of the second part 200. Conversely, switching from the rotating mode to the fixing mode is performed by rotating the first part 100 in a clockwise direction (see FIG. 2) such that the first axis A1 and the second axis A2 are coaxial or parallel. In this case, the user does not have to press the button 410 of the mode setting unit 400 because the first part 100 rotates in the clockwise direction by its own weight.

The button 410 is one of the components constituting the mode setting unit 400. A structure and operation of the mode setting unit 400 will be described later.

Hereinafter, the first to third parts 100, 200, and 300 and the mode setting unit 400 will be described sequentially with reference to the drawings.

Figure 3A:
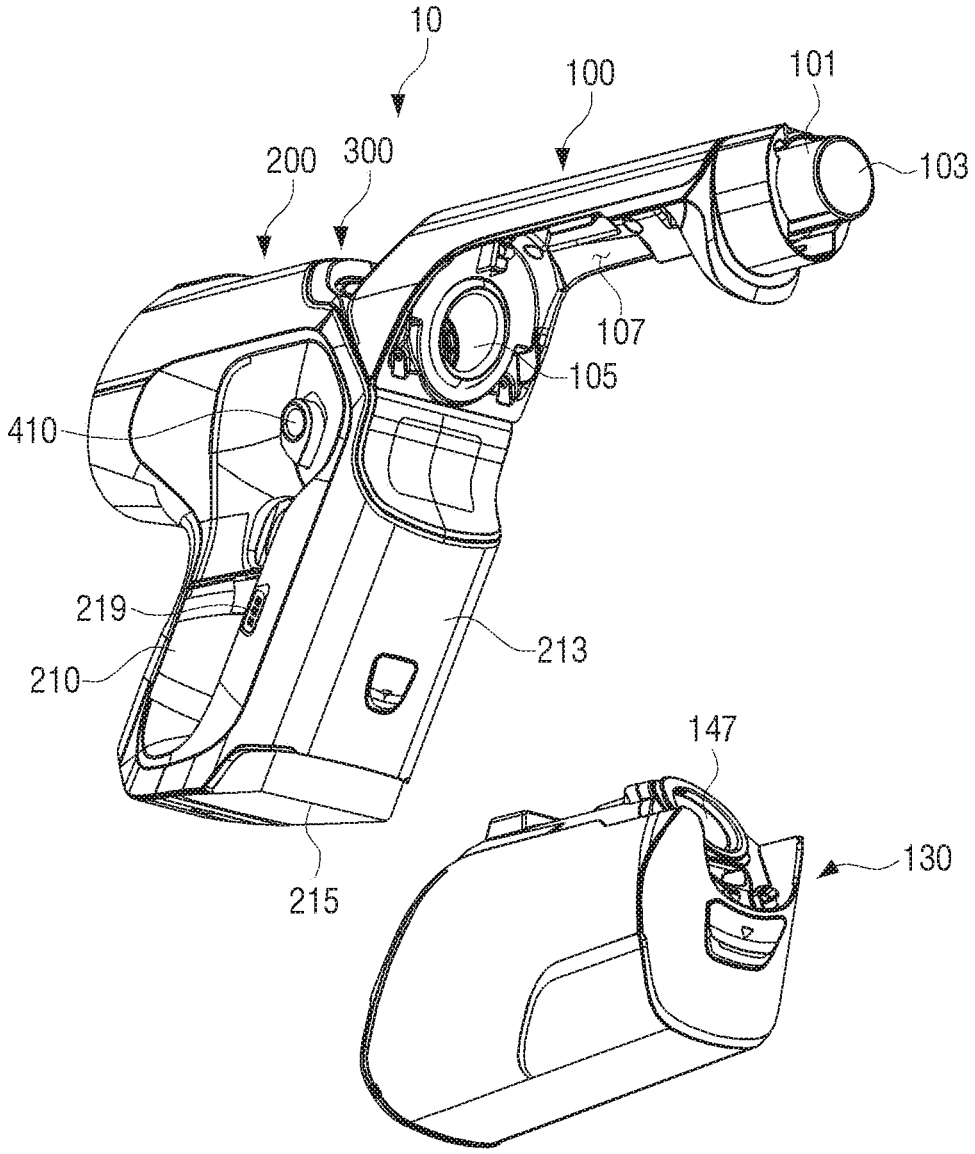
FIGS. 3A and 3B are exploded perspective views illustrating a state in which a dust collection unit is separated from the first part of the handy-stick type vacuum cleaner according to an embodiment of the disclosure.
Figure 3B:
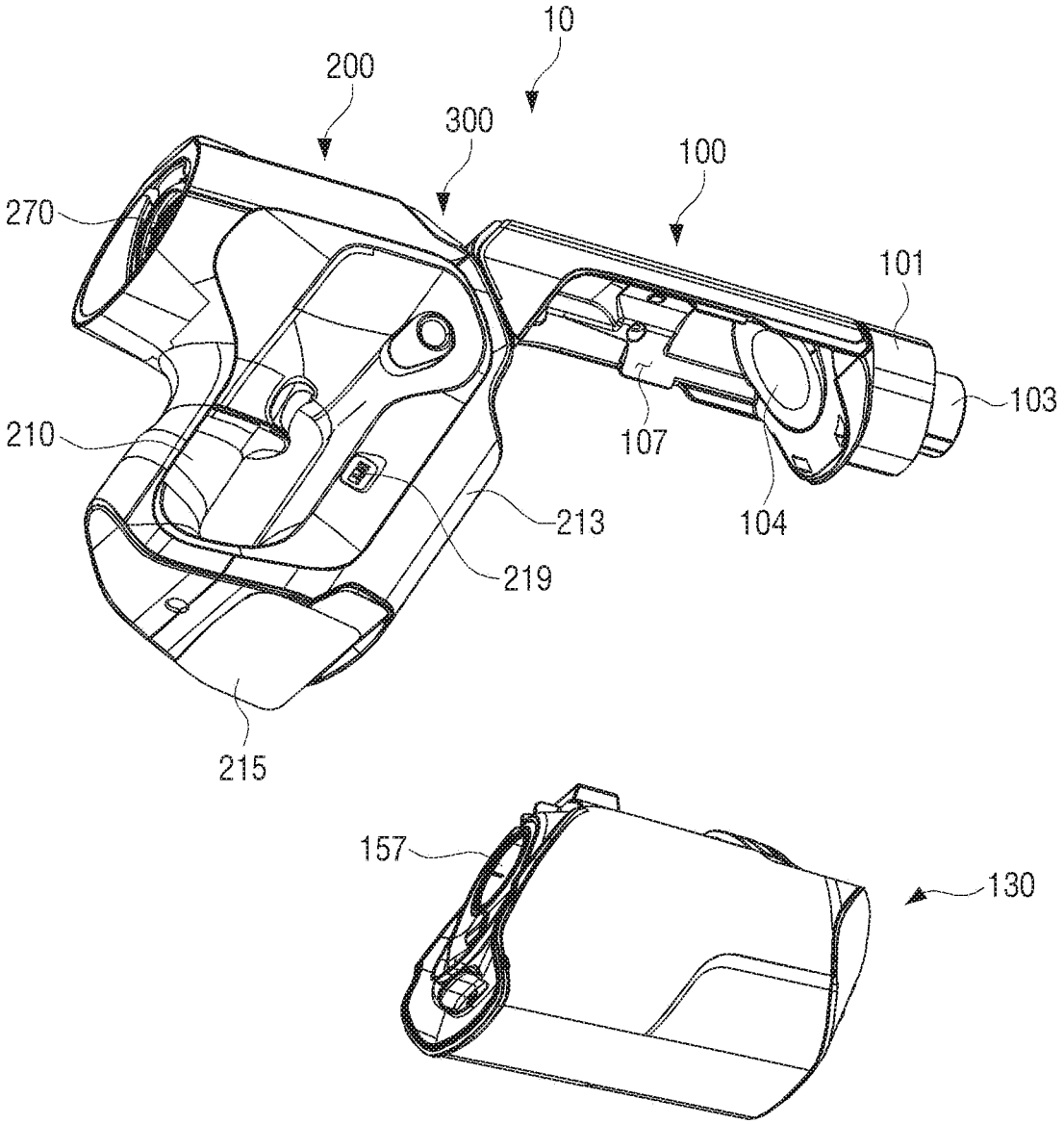

FIGS. 3A and 3B are exploded perspective views illustrating a state in which a dust collection unit is separated from the first part of the handy-stick type vacuum cleaner according to an embodiment of the disclosure.

Referring to FIGS. 3A and 3B, the first part 100 is provided with a mounting space 107 in which the dust collection unit 130 is detachably mounted. The first portion 100 is provided with a connection pipe 103 connected to an extension tube (see FIG. 20) at a tip portion 101 thereof. The connection pipe 103 is connected to a first hole 104 disposed at one side of the mounting space 107.

The first hole 104 is connected to a suction hole 147 of the dust collection unit 130 when the dust collection unit 130 is mounted in the mounting space 107. Accordingly, air including dust introduced into the first part 100 through the connection pipe 103 may move into the dust collection unit 130. A sealing member for maintaining airtightness may be disposed between the first hole 104 and the suction hole 147.

A second hole 105 connected to one end 510 (see FIG. 5) of the flexible tube 500 is disposed at the other side of the mounting space 107. The second hole 105 is connected to a discharge hole 157 of the dust collection unit 130 when the dust collection unit 130 is mounted in the mounting space 107. Accordingly, the air separated from the dust in the dust collection unit 130 may move to the flexible tube 500 through the discharge hole 157. Sealing members for maintaining airtightness may be disposed between the second hole 104 and the discharge hole 157 and between the second hole 104 and the one end 510 of the flexible tube 500, respectively.

As described above, the air including the dust introduced into the first part 100 is separated from the dust while passing through the dust collection unit 130 and then moves to the second part 200 through the flexible tube 500 disposed in the third part 300. The air moved to the second part 200 is filtered by an exhaust filter 270 through the suction motor 250 and then discharged to the outside of the second part 200.

Figure 4:
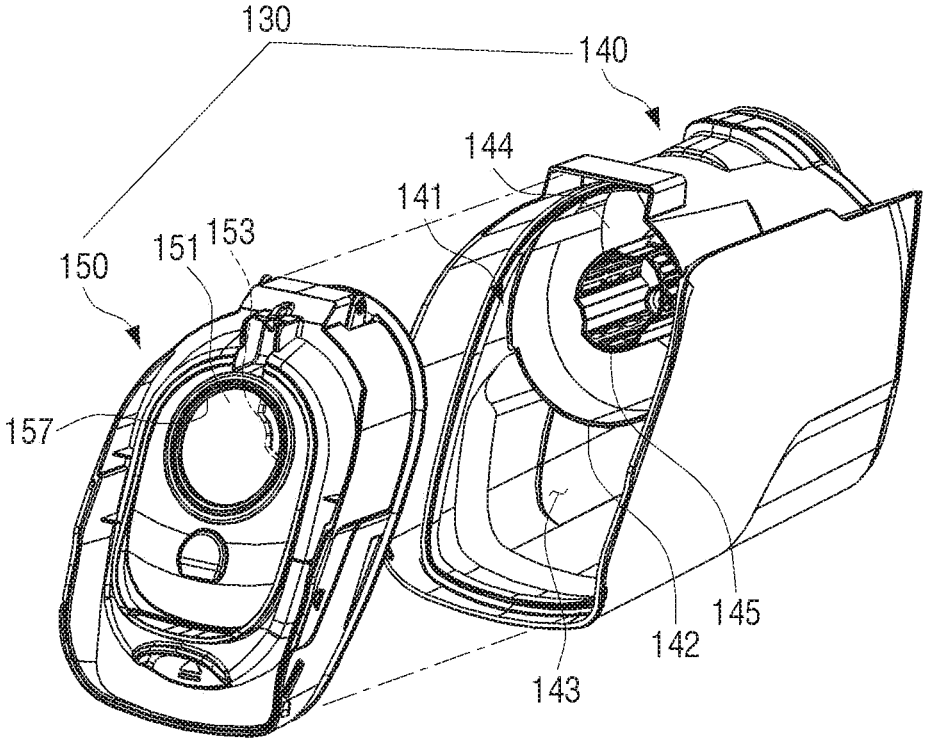
FIG. 4 is an exploded perspective view illustrating the dust collection unit.

FIG. 4 is an exploded perspective view illustrating the dust collection unit.

Referring to FIG. 4, the dust collection unit 130 includes a dust collection container 140 having one side of which is opened, and a cover 150 for opening and closing the opened one side of the dust collection container 140.

The dust collection container 140 includes a cyclone part 141 and a dust collection space 142 disposed at one side of the cyclone part 141 to collect dust discharged by a centrifugal force from the cyclone part 141.

The cyclone part 141 has a cylindrical pipe 143 (see FIG. 5) disposed at the center thereof, and a spiral guide 144 is formed between an inner circumferential surface of the cyclone part 141 and an outer circumferential surface of the cylindrical pipe 143 to add a turning force to the air introduced into the cyclone part 141. In addition, the cyclone part 141 is provided with a dust discharge part 142 as an inlet for discharging the dust to the dust collection space 143 at the top thereof.

A grill filter 145 for filtering the air separated from the dust by the centrifugal force while turning along the spiral guide 144 is disposed inside the cyclone part 141. A tip of the grill filter 145 is insertedly connected to a through hole 153 of the cover part 150. Accordingly, air passing through the grill filter 145 moves into the discharge part 150 through the through hole 153.

In this case, it is preferable that airtightness is maintained between an inner circumference of the through hole 153 and an outer circumference of the tip of the grill filter 145 to prevent the dirt floating in the cyclone part 141 from directly introducing into the cover part 150. To this end, a ring-shaped gasket (not illustrated) may be inserted into the through hole 153 and the tip of the grill filter 141 may be coupled to the gasket in a press-fitted state.

The cover part 150 is mounted in the mounting space 107 of the first part 100 in a state in which the opened one side of the dust collection container 140 is closed. When the dust collected in the dust collection space 143 is discarded, the cover part 150 is separated from the dust collection container 140 to open one side of the dust collection container 140.

A filter 151 is disposed inside the cover part 150. Accordingly, the air introduced into the cover part 150 after passing through the grill filter 145 is once again filtered by the filter 151.

The cover part 150 is connected to a communication tube 313 (see FIG. 6) of the first connection member 310 to be described later through the discharge hole 157 formed at a rear side. The communication tube 313 of the first connection member 310 is connected to the flexible tube 500. Accordingly, the air discharged from the inside of the cover part 150 through the discharge hole 157 may move to the suction motor 250 through the flexible tube 500.

Figure 5:
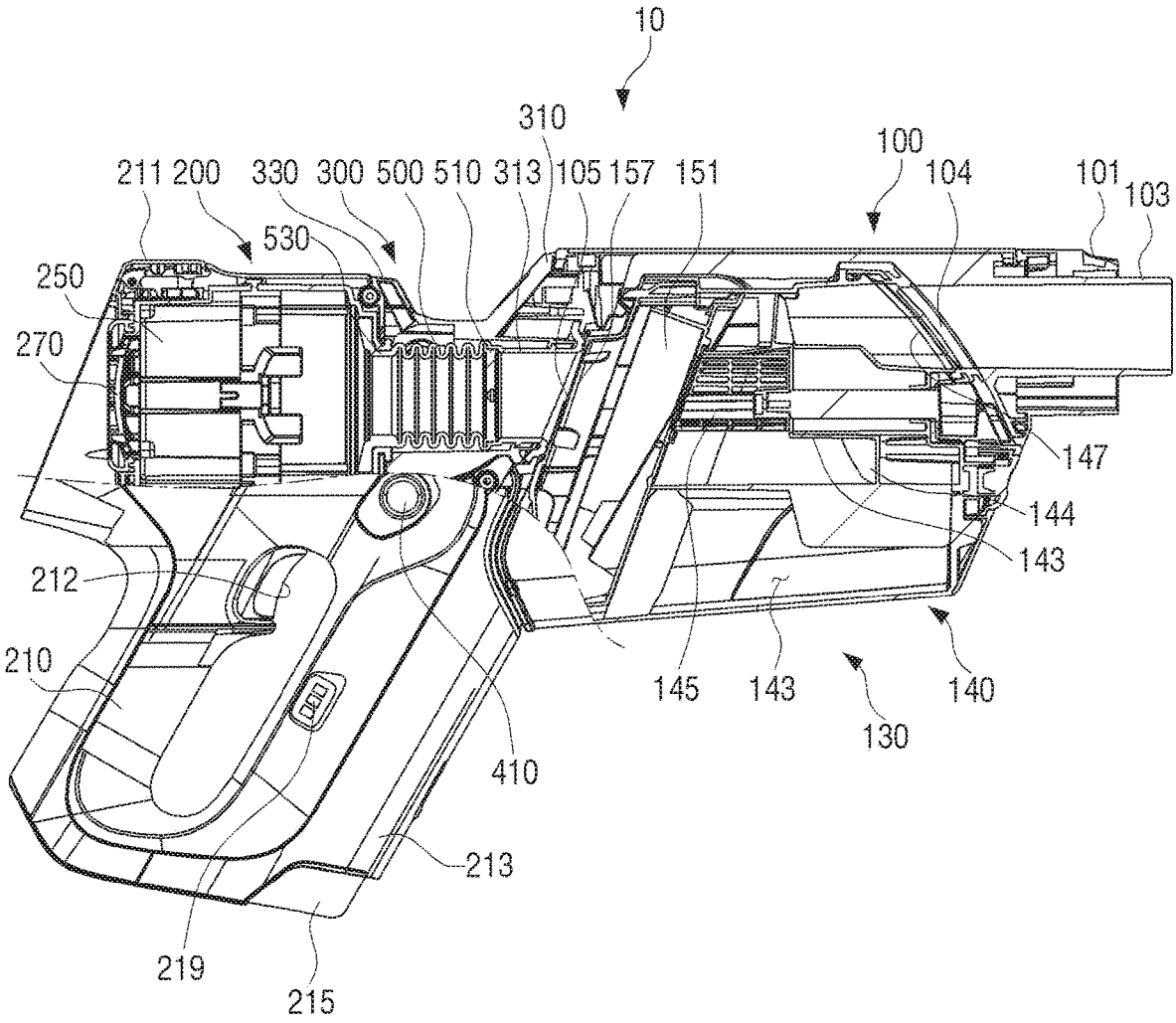
FIG. 5 is a partially cut-away cross-sectional view taken along a line A-A indicated in FIG. 1 and illustrates an air flow path inside the handy-stick type vacuum cleaner according to an embodiment of the disclosure.

FIG. 5 is a partially cut-away cross-sectional view taken along a line A-A indicated in FIG. 1 and illustrates an air flow path inside the handy-stick type vacuum cleaner according to an embodiment of the disclosure.

Referring to FIG. 5, the second part 200 is formed with the handle 210 that may be gripped by the user, and the suction motor 250 corresponding to a suction source is disposed therein. The suction motor 250 is connected in a state capable of communicating with the other end 530 of the flexible tube 500 so that a suction force is applied to the air flow path formed in the handy-stick type vacuum cleaner 10.

A battery mounting part 213 may be disposed in front of the handle 210 of the second portion 200, and a rechargeable battery 215 may be detachably mounted to the battery mounting part 213.

In addition, a power switch 211 may be disposed at a rear upper end of the second part 200, a trigger 212 may be disposed at a front upper end of the handle 210, and a display 219 may be disposed on one side of the battery mounting part 213. The display unit 219 may be configured of a plurality of light emitting diodes (LEDs), respectively, indicating a normal mode, a turbo mode, and a pause mode of the suction motor 250.

The power switch 211 is a switch for turning on/off the suction motor 250 and the trigger 212 is a switch for controlling an operation of the suction motor 250. The suction motor 250 may be controlled through a combination of the power switch 211 and the trigger 212.

That is, when the power switch 211 is turned on, the suction motor 250 operates in the normal mode, and when the power switch 211 is turned off, the operation of the suction motor 250 is stopped.

The trigger 212 may control a driving speed of the suction motor 250 to pause the suction motor 250. That is, when the trigger 121 is pressed for less than a predetermined t seconds (e.g., 3 seconds) in a state in which the power switch 211 is turned on and the suction motor 250 operates in the normal mode, the pause mode in which the operation of the suction motor 250 is paused may be set. When the trigger is pressed for less than t seconds again in the pause mode, the pause mode may be released and switched to the normal mode. The display 219 is driven even in the pause mode because the display 219 is continuously driven until the power switch 211 is turned off after being turned on.

In addition, when the trigger 212 is pressed for t seconds or more in a state in which the suction motor 250 operates in the normal mode, the suction motor 250 may be switched from the normal mode to the turbo mode. The turbo mode may only be maintained while pressing the trigger 212 after switching from the normal mode to the turbo mode, and when the trigger 212 is released, the suction motor 250 may operate in the normal mode again.

The control method of the suction motor 250 is not limited to the above-described control method and the suction motor 250 may be controlled in various methods.

Meanwhile, a grill type exhaust filter 270 that may discharge the air discharged from the suction motor to the outside of the second part 200 may be disposed at the rear of the second part 200.

Figure 6:
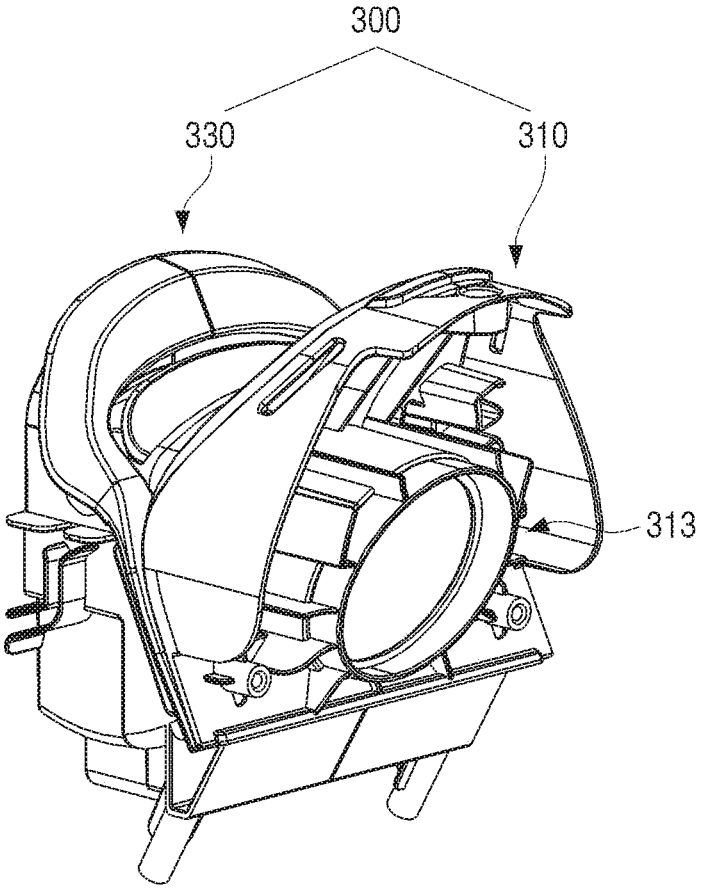
FIG. 6 is an assembled perspective view illustrating an example in which the third part includes a first connection member and a second connection member.
Figure 7:
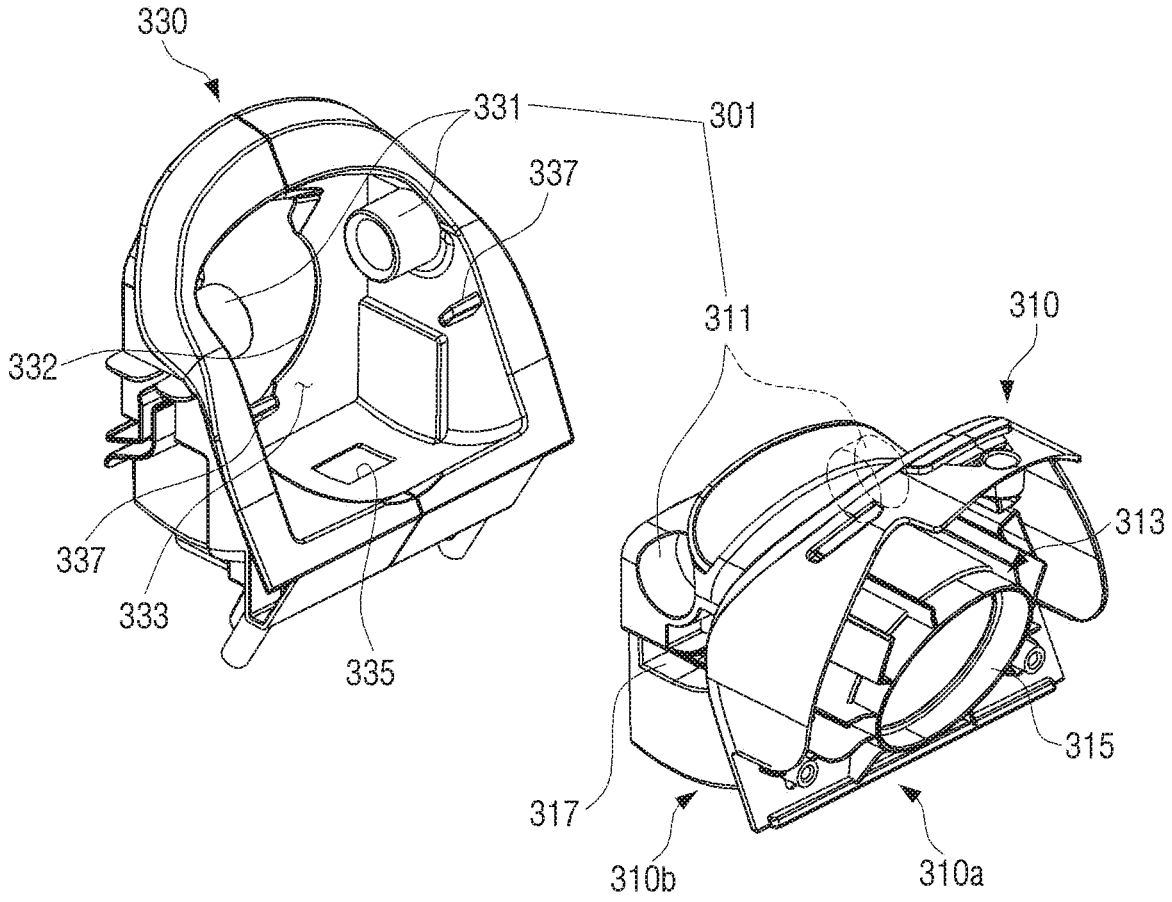
FIG. 7 is an exploded perspective view illustrating the third part illustrated in FIG. 6.
Figure 8:
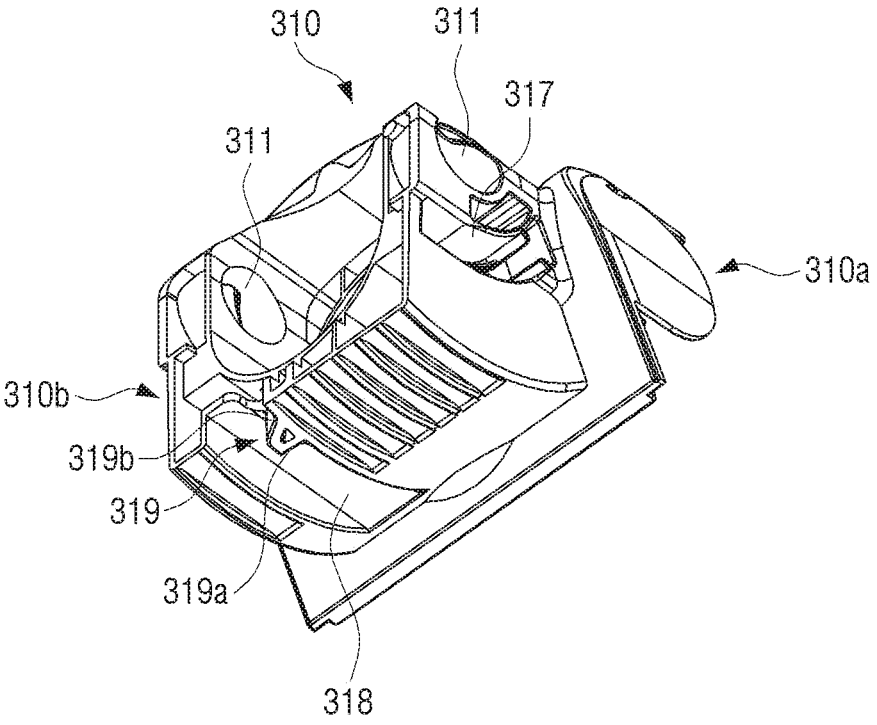
FIG. 8 is a perspective view illustrating a bottom of the first connection member illustrated in FIG. 6.

FIG. 6 is an assembled perspective view illustrating an example in which the third part includes a first connection member and a second connection member, FIG. 8 is an exploded perspective view illustrating the third part illustrated in FIG. 6, and FIG. 7 is a perspective view illustrating a bottom of the first connection member illustrated in FIG. 6.

Referring to FIGS. 6 to 8, the third portion 300 includes the first connection member 310 coupled to the first part 100 and the second connection member 330 coupled to the second part 200. In this case, the first and second connection members 310 and 330 have the rotation shaft 301 which serves as a rotation center. The rotation shaft 301 may be formed by a pair of coupling holes 311 of the first connection member 310 and a pair of shaft protrusions 331 of the second connection member 330, which are rotatably inserted into the pair of coupling holes 311, respectively.

A front portion 310*a* of the first connection member 310 is coupled to the rear of the first part 100. One end 315 of the communication tube 313 formed in the first connection member 310 is connected to the discharge hole 157 of the cover part 150, and the other end thereof is connected to one end 510 of the flexible tube 500.

A rear portion 310*b* of the first connection member 310 may be disposed in a rotatable state in an accommodation space 333 of the second connection member 330. A pair of guide grooves 317 having an arc shape corresponding to a rotational trajectory of the first connection member 310 are formed on both side surfaces of the rear portion 310*b*. A pair of guide protrusions 337 of the second connection member 330 are slidably inserted into the pair of guide grooves 317, respectively. An angle through which the first connection member 310 may rotate may correspond to a length of the pair of guide grooves 317.

Referring to FIG. 8, a long groove 318 is formed in the front and rear directions of the first connection member 310 at the bottom of the rear portion 310*b* of the first connection member. One side wall of the long groove 318 is formed with an engaging protrusion 319 protruding toward an opposite side wall. The tip of the engaging protrusion 319 is spaced apart from the opposite side wall of the long groove 318 such that a gap is formed with the opposite side wall of the long groove 318.

The gap is an escape space in which a locking protrusion 435 moving from a locked position (see FIG. 14) to an unlocked position (see FIG. 17) does not interfere with the engaging protrusion 319 when the locking protrusion 435 rotates the first connection member 310 in a counterclockwise direction (see FIG. 2).

The engaging protrusion 319 is locked by the locking protrusion 435 of a latch 430 in the fixing mode and unlocked in the rotating mode. Accordingly, the first part 100 coupled with the first connection member 310 may be switched between a rotatable state and a non-rotatable state by the mode setting unit 400.

One side surface 319*a* of the engaging protrusion 319 faces one side surface 435*a* of the locking protrusion 435 in the fixing mode, and the other side surface 319*b* located opposite one side surface 319*a* faces the other side surface 435*b* of the locking protrusion 435 in the rotating mode.

One side surface 319*a* of the engaging protrusion 319 and one side surface 435*a* of the locking protrusion 435 may be formed in a direction substantially perpendicular to a direction in which the engaging protrusion 319 moves according to the rotation of the first connection member 310. Such a structure is considered to prevent the latch 430 from moving from a locked position to an unlocked position even when a force for rotating the first part 100 in the counterclockwise direction (see FIG. 2) in the fixing mode is applied.

Referring to FIG. 7, a through hole 332 through which the flexible tube 500 penetrates is formed at the rear of the second connection member 330, and the accommodation space 333 into which the rear portion 310*b* of the first connection member 310 is rotatably inserted is formed inside the second connection member 330.

A lead-in hole 335 through which a portion of the mode setting unit 400 (specifically, the locking protrusion 435 of the latch 430) may be led into the accommodation space 333 of the second connection member may be formed in the bottom of the second connection member 330.

Hereinafter, a structure of the mode setting unit 400 which may set the first and second parts 100 and 200 to the fixing mode or the rotating mode by locking or unlocking the third part 300 is described with reference to FIGS. 9 to 12.

Figure 9:
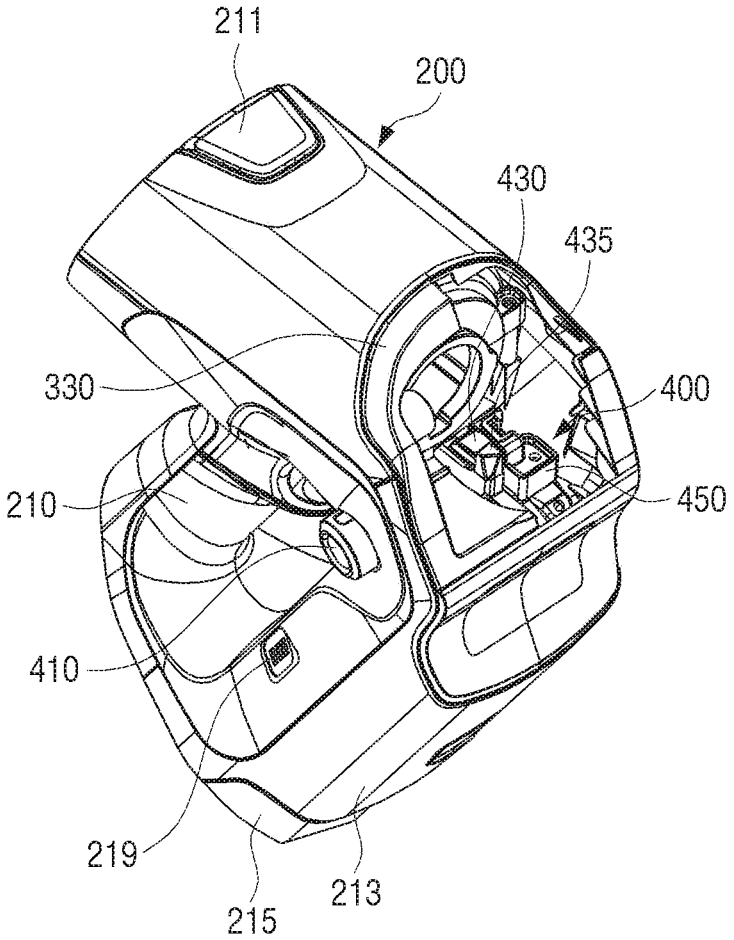
FIG. 9 is a perspective view illustrating a state in which a mode setting unit is disposed inside the second part.

FIG. 9 is a perspective view illustrating a state in which a mode setting unit is disposed inside the second part, FIG.

Figure 11:
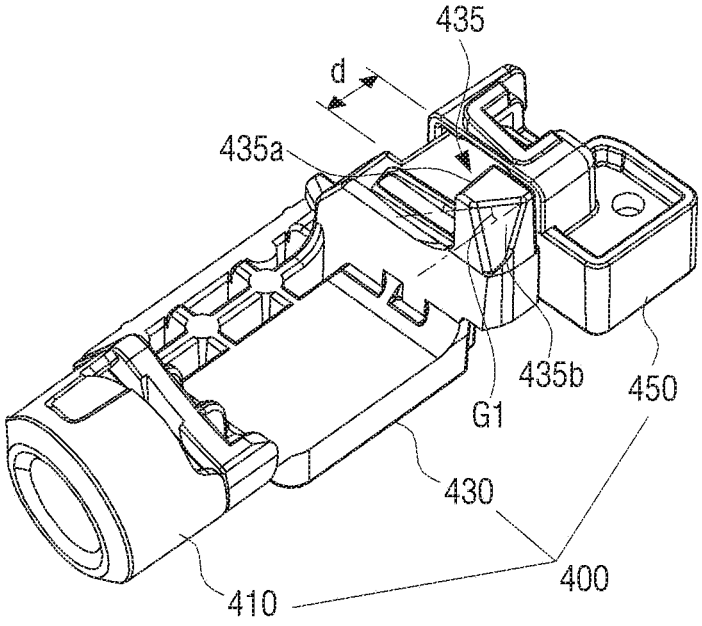
FIGS. 11 and 12 are an assembled perspective view and an exploded perspective view illustrating the mode setting unit.
Figure 12:
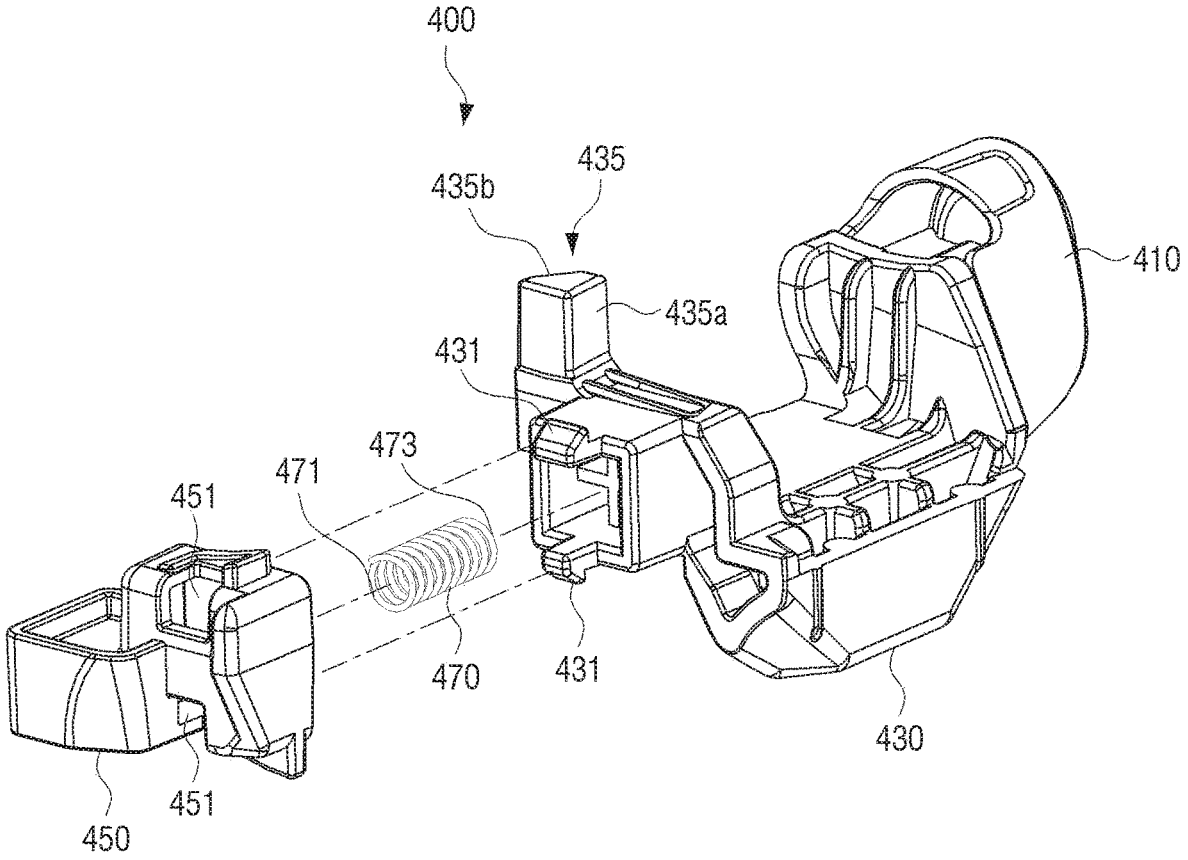

10 is a perspective view illustrating a state in which the mode setting unit is disposed below the third part, and FIGS. 11 and 12 are an assembled perspective view and an exploded perspective view illustrating the mode setting unit.

Referring to FIG. 9, the mode setting unit 400 may be disposed on an inner upper portion of the second portion 200. In this state, the locking protrusion 435 of the latch 430 protrudes into the accommodation space 333 through the lead-in hole 335 formed in the bottom of the second connection member 330 of the third portion. In this case, the locking protrusion 435 preferably has a length that may interfere with the engaging protrusion 319 of the first connection member 310. In addition, the lead-in hole 335 of the second connection member 330 may have a width such that the locking protrusion 435 may move to the locked position (see FIG. 14) and the unlocked position (see FIG. 17). A direction in which the locking protrusion 435 moves may be a direction parallel to a direction of a hinge axis 301.

Figure 10:
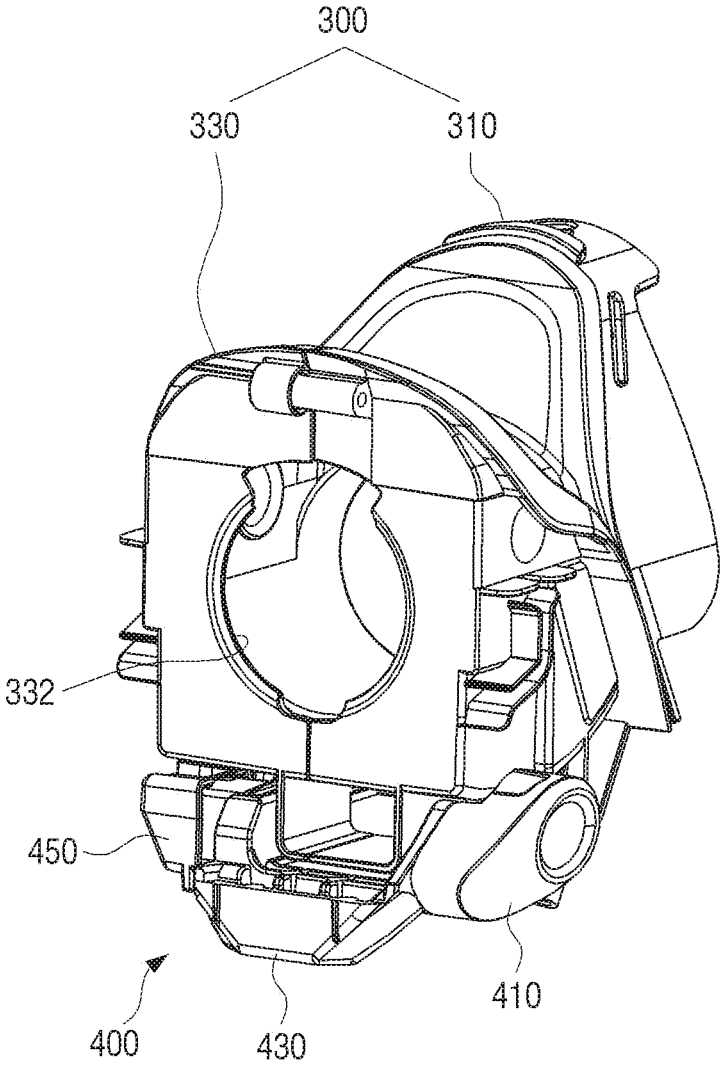
FIG. 10 is a perspective view illustrating a state in which the mode setting unit is disposed below the third part.

Referring to FIG. 10, the mode setting unit 400 may be disposed below the third portion 300. Specifically, the mode setting unit 400 may be disposed below the second connection member 330 of the third portion 300.

Referring to FIGS. 11 and 12, the mode setting unit 400 may include a button 410, a latch 430, and a holder 450.

A portion of the button 410 protrudes externally from the second portion 200. Specifically, the button 410 may be exposed adjacent to the trigger 212 disposed above the handle 210 as illustrated in FIG. 1. The arrangement of the button 410 is considered to allow the user to press the button 410 by using a finger of the hand holding the handle 210.

The button 410 is coupled to one side of the latch 430, and when the button 410 is pressed by the user, the latch 430 moves together with the button 410 in a direction parallel to the rotation shaft 301.

The latch 430 has the locking protrusion 435 protruding from an upper portion thereof. The locking protrusion 435 interferes with the engaging protrusion 319 at the locked position to prevent the first part 310 from rotating in the counterclockwise direction (see FIG. 2).

The locking protrusion 435 has one side surface 435*a* in contact with one side surface 319*a* of the engaging protrusion 319 formed in the first part 310 in the fixing mode, and the other side surface located opposite one side surface 435*a*.

As described above, one side surface 435*a* of the locking protrusion 435 and one side surface 319*a* of the engaging protrusion 319 may be formed in a direction substantially perpendicular to a direction in which the engaging protrusion 319 moves according to the rotation of the first connection member 310. In this case, one side surface 435*a* of the locking protrusion 435 and one side surface 319*a* of the engaging protrusion 319 may be disposed in parallel to each other. Such a structure is considered to prevent the latch 430 from moving from a locked position to an unlocked position even when a force for rotating the first part 100 in the counterclockwise direction (see FIG. 2) in the fixing mode is applied to the first part 100.

In a case in which the force for rotating the first part 100 in the counterclockwise direction (see FIG. 2) in the fixing mode is excessively applied to the first part 100, if the first part 100 is not rotated and remains fixed, the locking protrusion 435 or the engaging protrusion 319 may be damaged. In order to cope with such damage, at least one of one side surface 435*a* of the locking protrusion 435 or one side surface 319*a* of the engaging protrusion 319 may be formed to be inclined as a first angle (about 5 degrees or less) with respect to the direction perpendicular to the direction in which the engaging protrusion 319 moves according to the rotation of the first connection member 310 (see FIG. 14).

The other side surface 435*b* of the locking protrusion 435 is formed to be inclined at a second angle G1 (see FIG. 14) greater than the first angle. In addition, the other side surface 319*b* of the engaging protrusion 319 is also formed to be inclined at a third angle G2 (see FIG. 14) that is greater than the first angle and is the same as or similar to the second angle G1.

Figure 19:
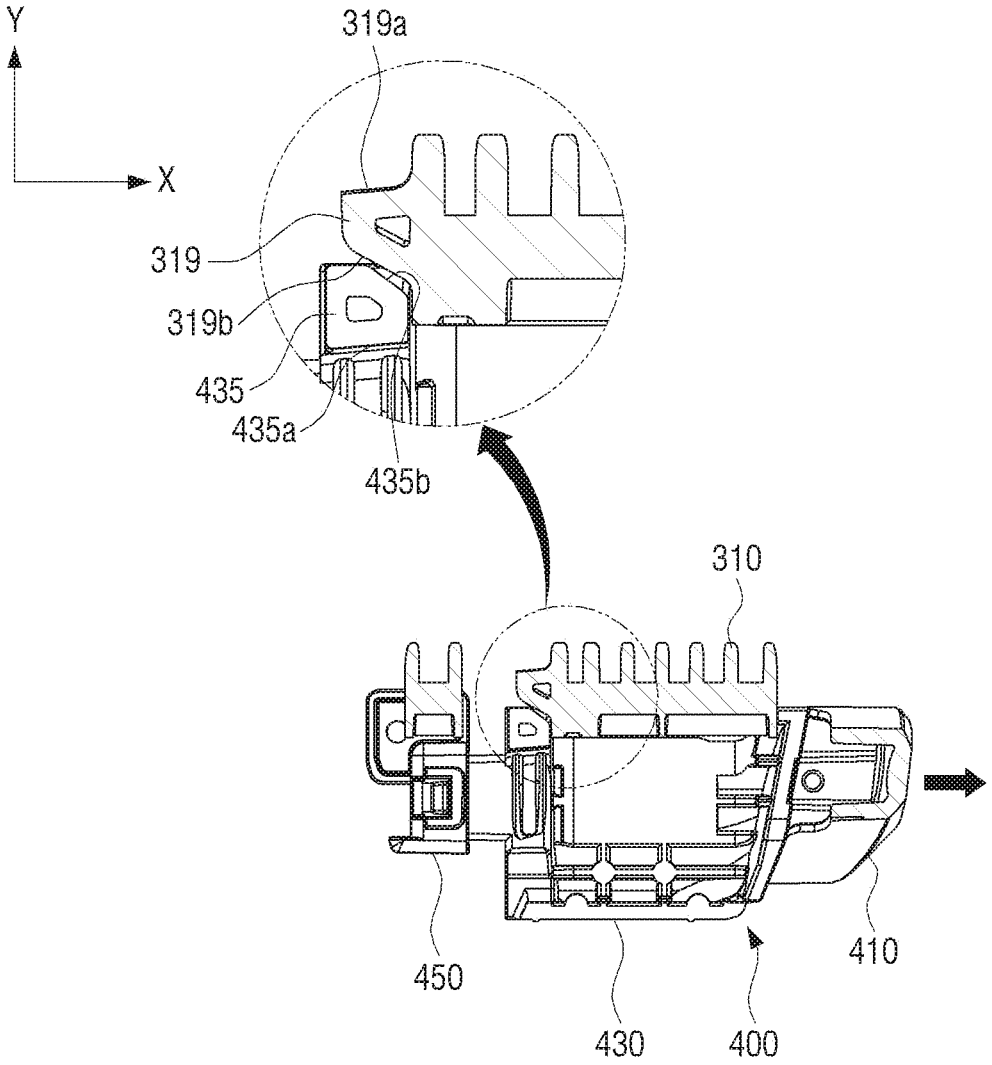
FIG. 19 is a cross-sectional view taken along a line E-E indicated in FIG. 18.

A direction in which the other side surface 435*b* of the locking protrusion 435 is inclined is a direction toward the engaging protrusion 319 side based on the arrangement of the locking protrusion 435 illustrated in FIG. 19. Similarly, a direction in which the other side surface 319*b* of the engaging protrusion 319 is inclined is a direction toward the locking protrusion 435 side based on the arrangement of the engaging protrusion 319 illustrated in FIG. 19.

As described above, as the other side surface 435*b* of the locking protrusion 435 and the other side surface 319*b* of the engaging protrusion 319 are formed to be inclined at the second and third angles, respectively, the switching from the rotating mode to the fixing mode is possible.

That is, in the rotating mode, when the first part 100 is rotated in the clockwise direction (see FIG. 2), the other side surface 435*b* of the locking protrusion 435 and the other side surface 319*b* of the engaging protrusion 319 are in contact with each other. In this case, the other side surface 435*b* of the locking protrusion 435 and the other side surface 319*b* of the engaging protrusion 319 may be disposed substantially in parallel to each other. In this state, when a force (which may be a force due to its own weight of the first part 100) is applied to the first part 100 to rotate the first part 100 in the clockwise direction, the other side surface 435*b* of the locking protrusion 435 is pressed by the other side surface 319*b* of the engaging protrusion 319 moving in the clockwise direction. Accordingly, when the engaging protrusion 319 passes through the locking protrusion 435 after the locking protrusion 435 moves to the unlocked position (see FIG. 17), the locking protrusion 435 moves to the locked position (see FIG. 14) by an elastic member 470 to be described later. Through such a process, the switching from the rotating mode to the fixing mode is possible.

In the above description, although the other side surface 435*b* of the locking protrusion 435 and the other side surface 319*b* of the engaging protrusion 319 are formed to be inclined, it is not necessary that both of the other side surfaces to be inclined, and even if at least one of the other two side surfaces is formed to be inclined, the switching from the rotating mode to the fixing mode is possible.

Referring to FIG. 12, on the other side of the latch 430, a pair of hooks 431 are formed to protrude toward the holder 450 at intervals. The pair of hooks 431 are snap-coupled in a detachable state to a pair of coupling holes 451 formed in the holder 450. In this case, the latch 430 is coupled to the holder 450 in a state in which the latch 430 may be moved by a predetermined distance d with respect to the holder 450.

The holder 450 is fixedly coupled to the inside of the second part 200 as illustrated in FIG. 9, and an elastic member 470 is disposed inside the holder 450. One side 471 of the elastic member 470 is supported on the inside of the holder 450 and the other side 473 thereof is supported on the other side of the latch 430. Accordingly, the latch 430 is coupled to the holder 450 in a state in which the latch 430 may be elastically moved by a predetermined distance d with respect to the holder 450. In addition, as the other side of the latch 430 is pressed by the elastic member 470, the locking protrusion 435 may always maintain the locked position in a state in which the button 410 is not pressed.

Hereinafter, a method of setting the fixed mode and the rotation mode through the mode setting unit will be described with reference to FIGS. 13 to 21.

Figure 13:
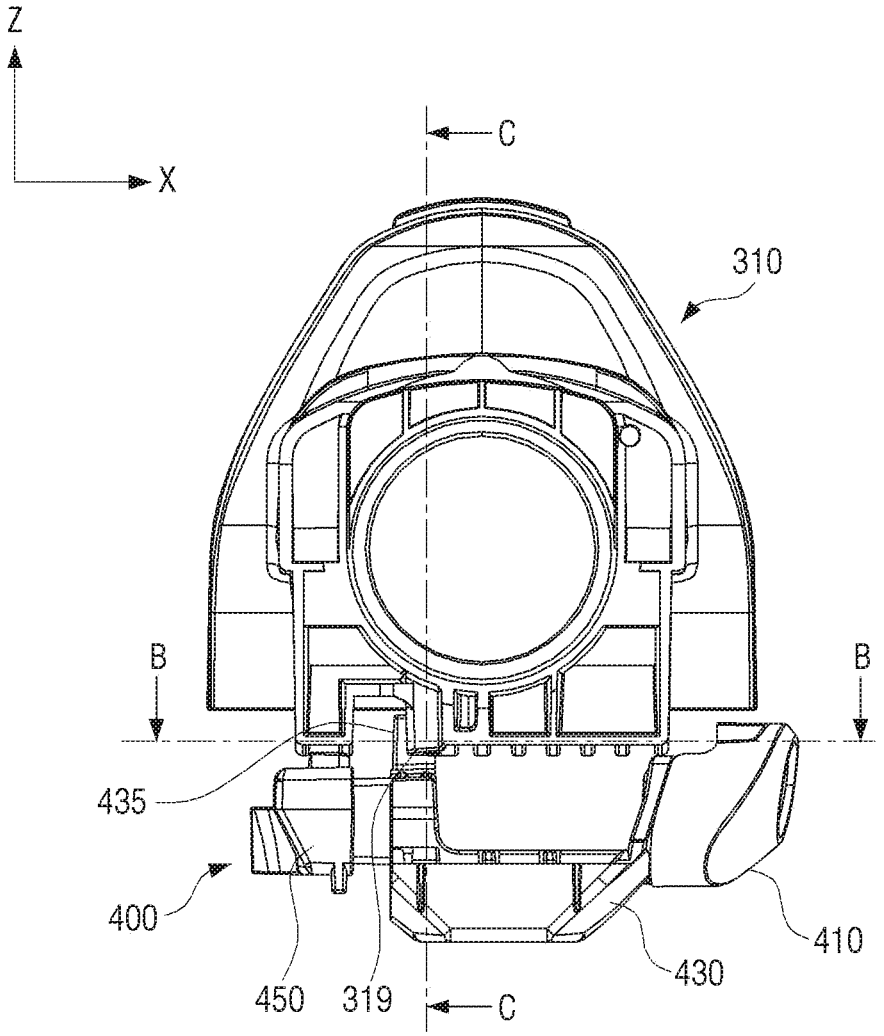
FIG. 13 is a view illustrating the first connection member and the mode setting unit in a case in which the handy-stick type vacuum cleaner according to an embodiment of the disclosure is in a fixing mode.
Figure 14:
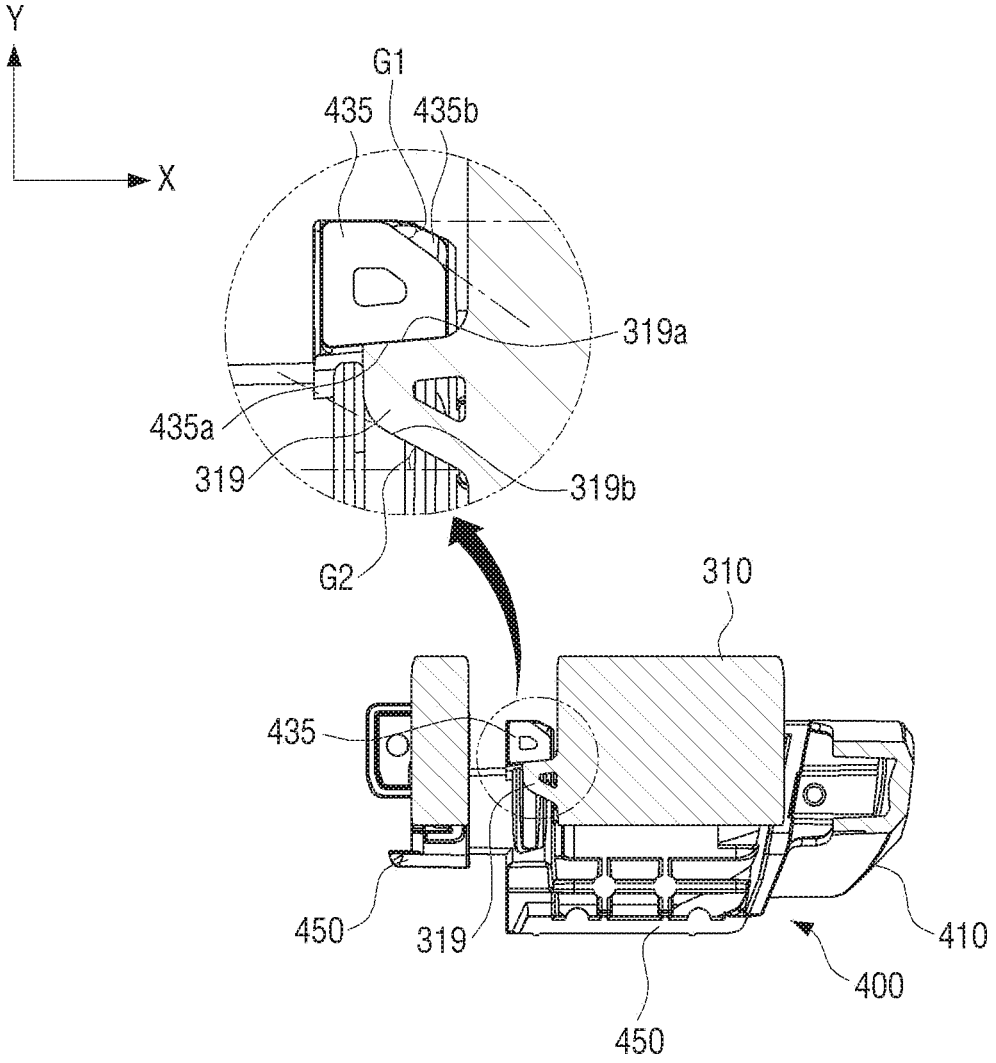
FIG. 14 is a cross-sectional view taken along a line B-B indicated in FIG. 13.
Figure 15:
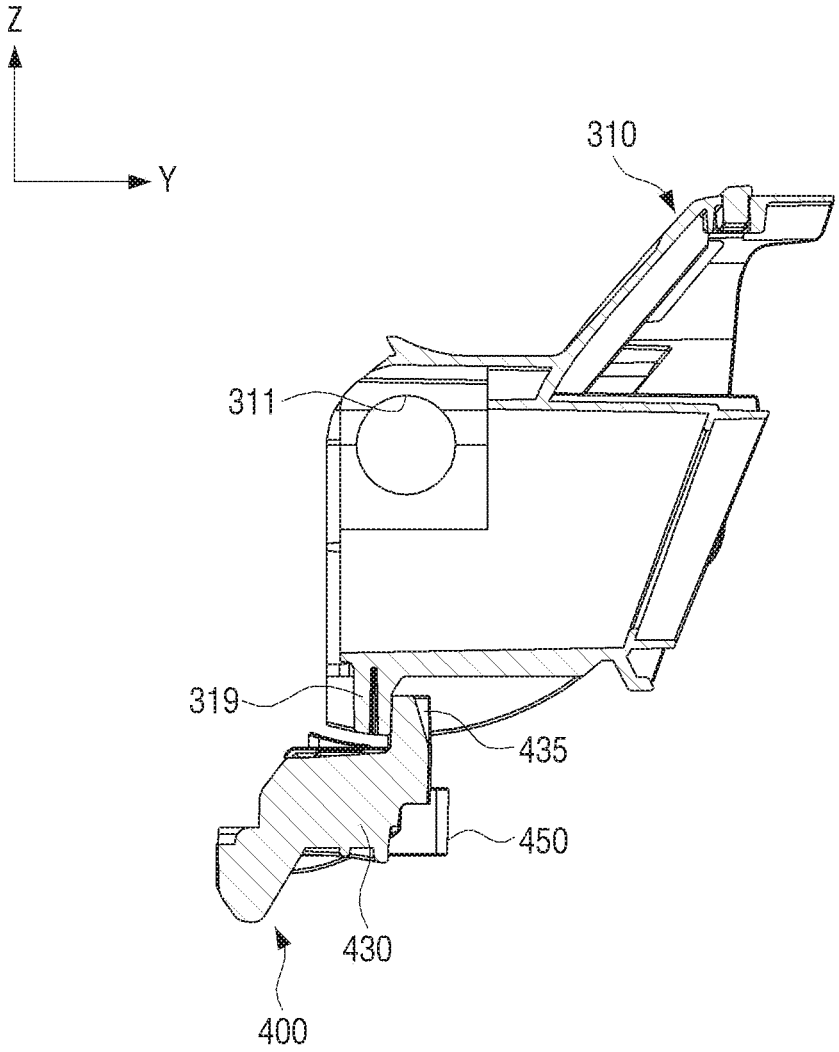
FIG. 15 is a cross-sectional view taken along a line C-C indicated in FIG. 13.
Figure 16:
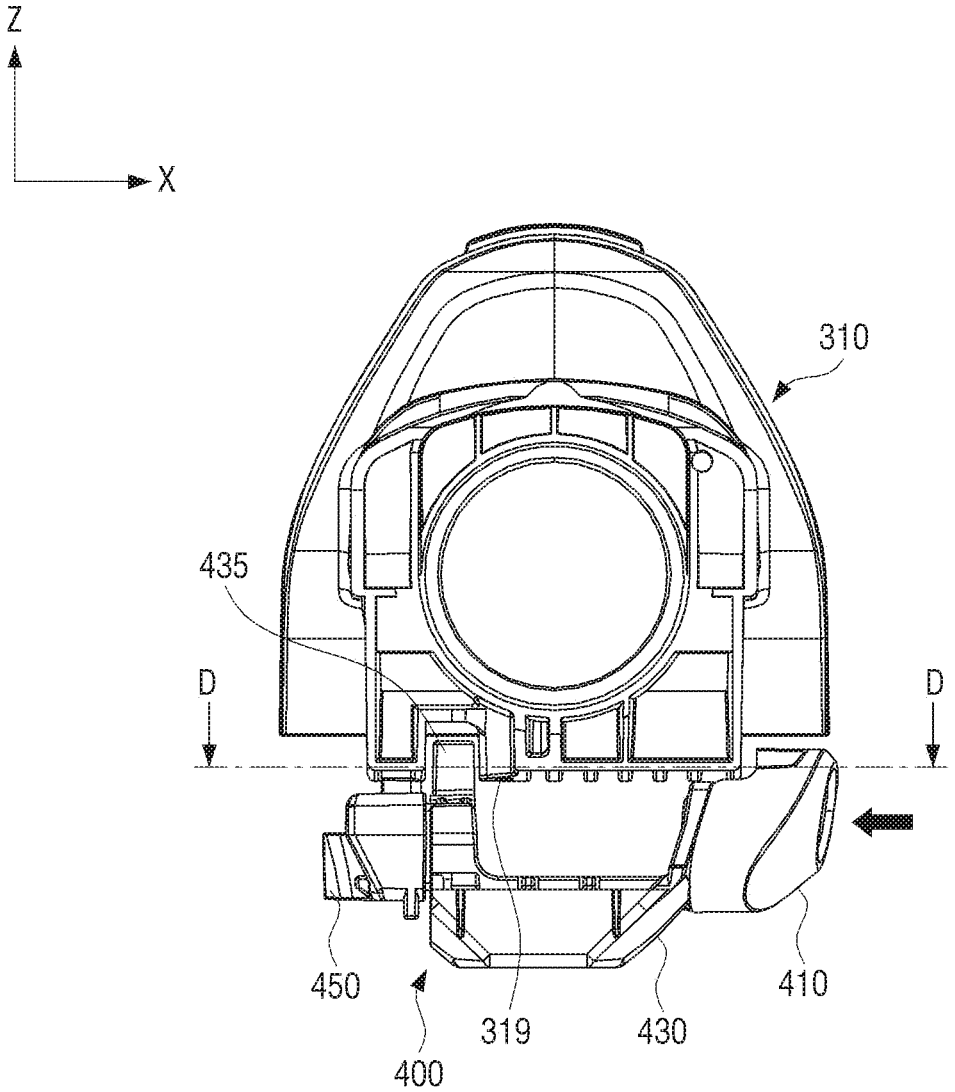
FIG. 16 is a view illustrating a state in which the mode setting unit is unlocked in the case in which the handy-stick type vacuum cleaner according to an embodiment of the disclosure is in the fixing mode.
Figure 17:
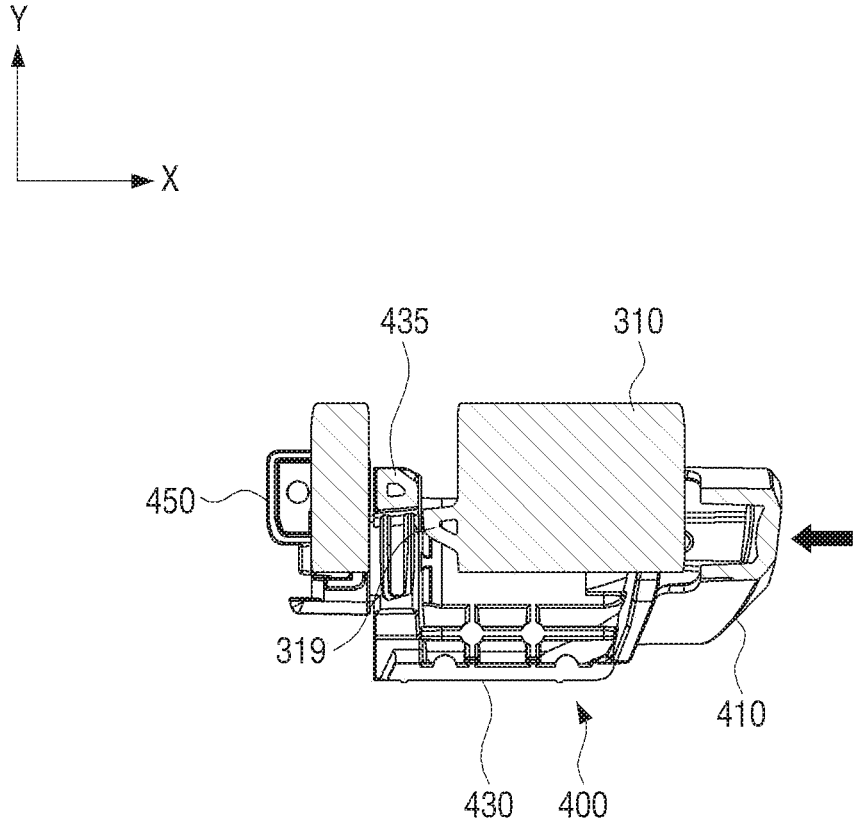
FIG. 17 is a cross-sectional view taken along a line D-D indicated in FIG. 16.
Figure 18:
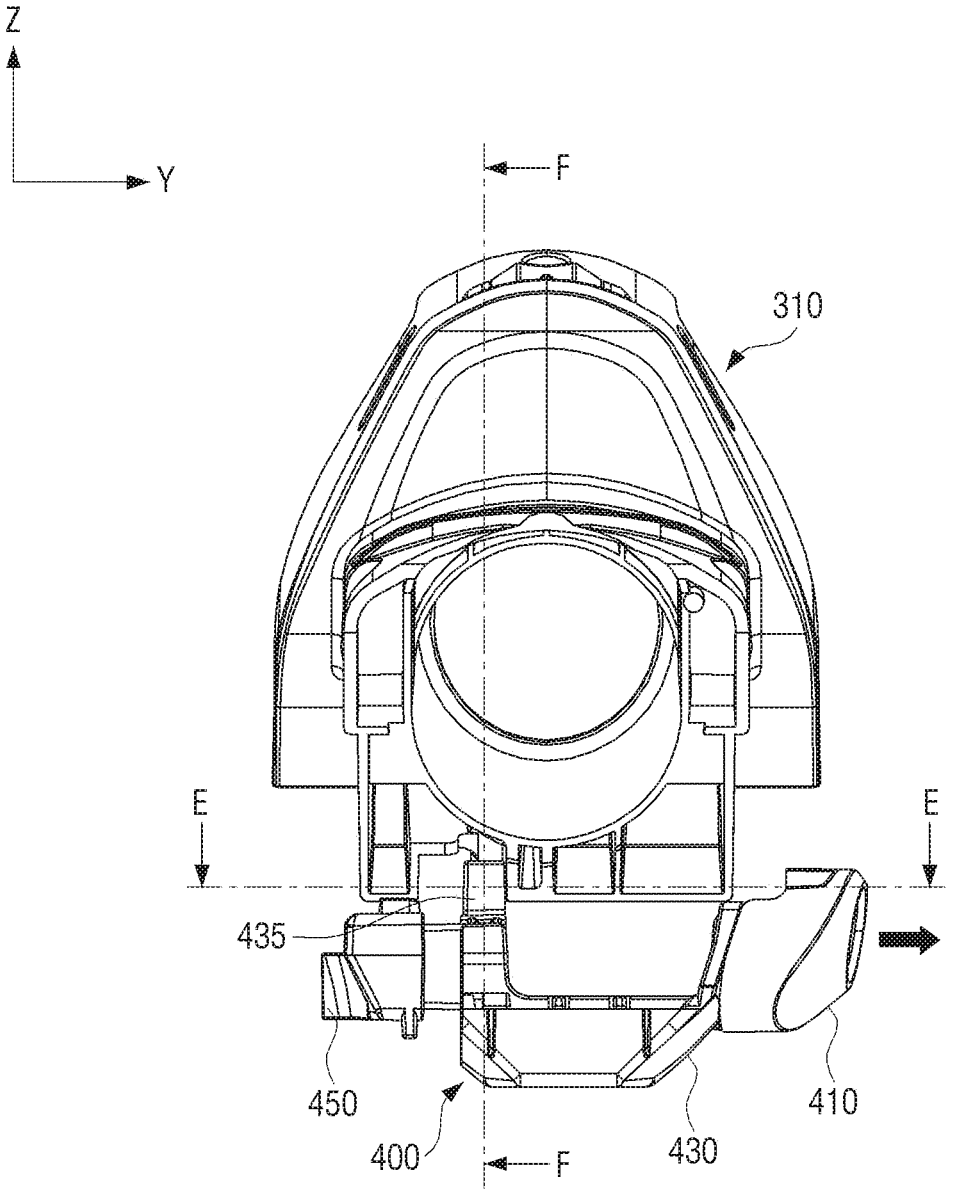
FIG. 18 is a view illustrating the first connection member and a locking part in a case in which the handy-stick type vacuum cleaner according to an embodiment of the disclosure is in a rotating mode.
Figure 20:
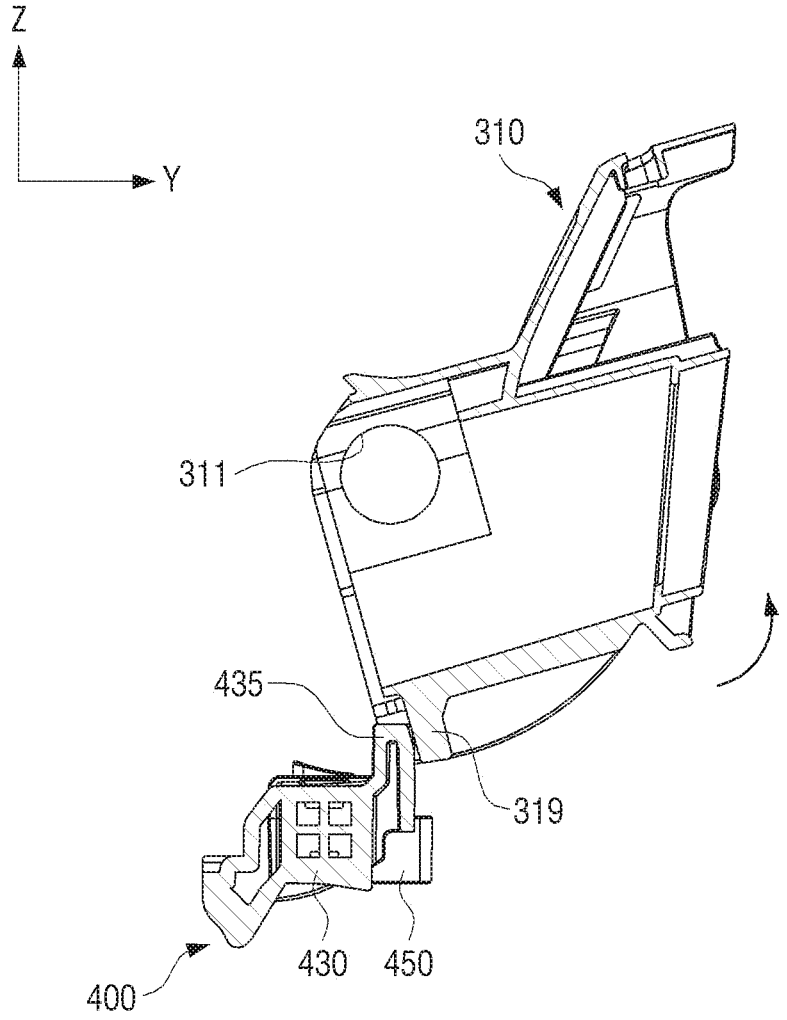
FIG. 20 is a cross-sectional view taken along a line F-F indicated in FIG. 18.
Figure 21:
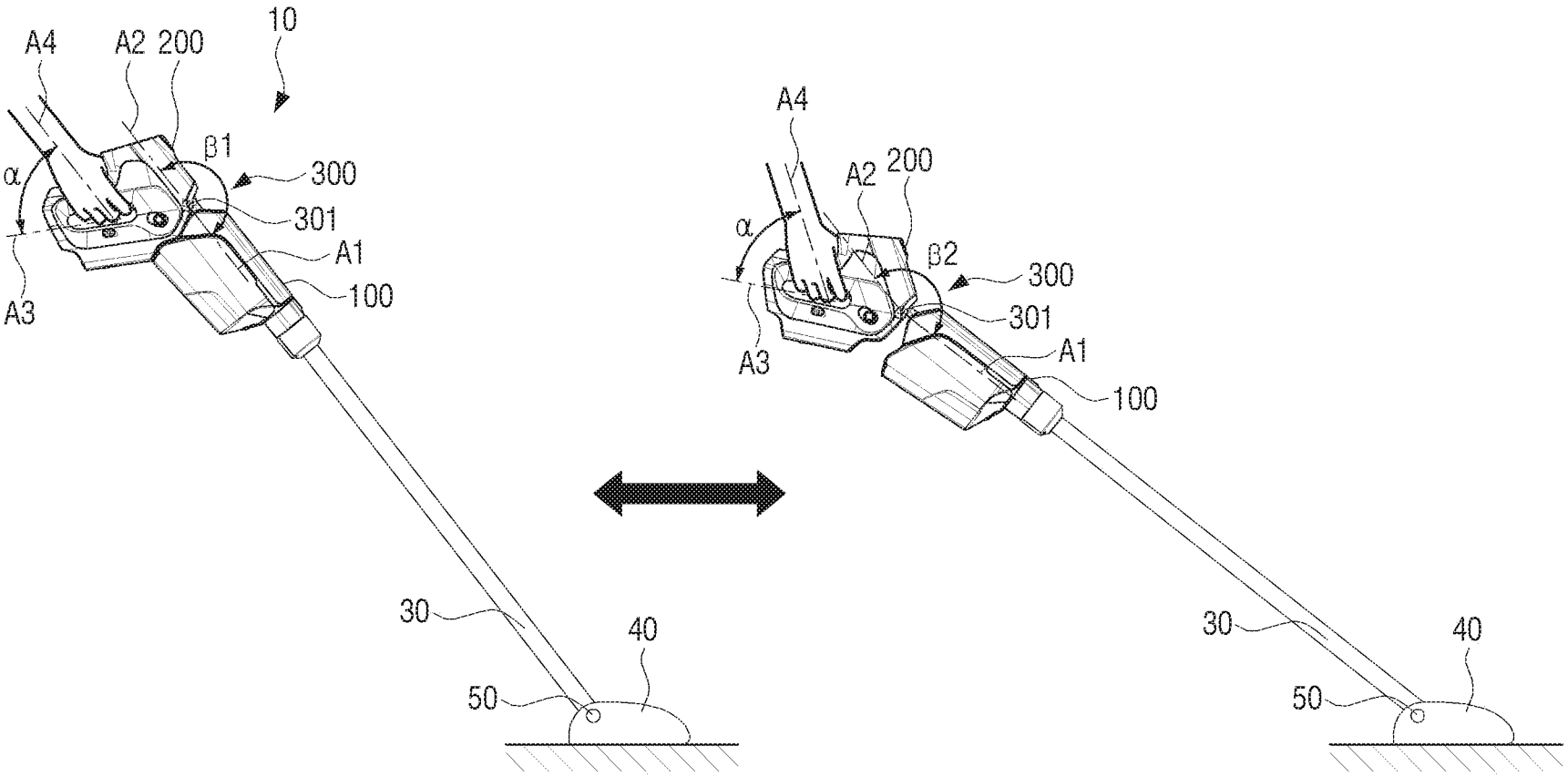
FIG. 21 is a view illustrating an example in which an extension tube having a suction nozzle is coupled to the handy-stick type vacuum cleaner according to an embodiment of the disclosure to perform a cleaning.

FIGS. 13 to 15 are views illustrating a position of the latch of the mode setting unit in the fixing mode, FIGS. 16 and 17 are views illustrating a state in which the latch of the mode setting unit moves to one side to switch from the fixing mode to the rotating mode, FIGS. 18 to 20 are views illustrating a position of the latch of the mode setting unit in the rotating mode, and FIG. 21 is a view illustrating an example in which an extension tube having a suction nozzle is coupled to the handy-stick type vacuum cleaner according to an embodiment of the disclosure to perform a cleaning.

Referring to FIGS. 13 to 15, the fixing mode is a state in which the third part 300 is locked to the first part 100 and the second part 200 by the mode setting unit 400 so as not be rotatable with each other. In this case, as illustrated in FIG. 21, the first axis A1 and the second axis A2 are coaxial or disposed in parallel, and an angle 131 between the first axis A1 and the second axis A2 may be 180 degrees.

In the fixing mode, as illustrated in FIG. 14, the engaging protrusion 319 formed on the first connection member 310 of the third part 300 is in a state in which the engaging protrusion 319 is locked by the locking protrusion 435 formed on the latch 430 of the mode setting unit 400, and the third part 300 may not be thus rotated in the counterclockwise direction as illustrated in FIG. 14.

In the case of the switching from the fixing mode to the rotating mode, when the button 410 is pressed in an X-axis direction as illustrated in FIG. 16, the latch 430 moves to the holder 450 side and the locking protrusion 435 moves to the unlocked position as illustrated in FIG. 17.

If the button 410 is released as illustrated in FIGS. 18 to 20 after the first part 100 is rotated by a predetermined angle in the counterclockwise direction so that the engaging protrusion 319 passes over the locking protrusion 435 and is positioned in front of the locking protrusion 435 in the state in which the button 410 is pressed, the button 410 is returned to the locked position by elastic force of the elastic member 470. Through such a process, the switching from the fixing mode to the rotating mode is possible.

In the rotating mode, the first axis A1 and the second axis A2 form a predetermined angle 132 not to be parallel to each other as illustrated in FIG. 21. When the cleaning is performed after the rotating mode is set, the first part 100 freely rotates with respect to the second part 200 about the hinge axis 301. Accordingly, when the cleaning is performed while repeatedly moving forward and backward the handy-stick type vacuum cleaner 10, an angle between the first axis A1 and the second axis A2 may be continuously varied between a first angle 131 and a second angle 132.

While the cleaning is performed while repeatedly moving forward and backward the handy-stick type vacuum cleaner 10, a third axis A3 along a length direction of the handle 210 and a fourth axis A4 extending from the user's hand 60 to a bottom arm may maintain a constant angle $\alpha$ or may have a slight degree of angular change.

As such, since the angle $\alpha$ between the third axis A3 and the fourth axis A4 is maintained substantially constant, the user naturally cleans while holding the handle 210 without bending or twisting the wrist during the cleaning.

In the case of the switching from the rotating mode to the fixing mode again, when the first part 100 is rotated in the clockwise direction, the other side surface 435*b* of the locking protrusion 435 is pressed by the other side surface 319*b* of the engaging protrusion 319 moving in the clockwise direction. Accordingly, when the engaging protrusion 319 passes through the locking protrusion 435 and is positioned at the rear of the locking protrusion 435 after the locking protrusion 435 moves to the unlocked position as illustrated in FIG. 17, the locking protrusion 435 is returned to the locked position as illustrated in FIG. 14 by the elastic force of the elastic member 470 while a pressing force applied to the locking protrusion 435 is released.

As described above, in the handy-stick type vacuum cleaner 10 according to an embodiment of the disclosure, since the second part 200 having the handle 210 is rotatably connected to the first part 100, it is not necessary to take an operation such as bending or twisting the wrist of the hand holding the handle 210 at the time of cleaning. Therefore, since a load applied to the wrist is greatly reduced during cleaning, the cleaning may be performed comfortably.

In addition, the handy-stick type vacuum cleaner 10 according to an embodiment of the disclosure may significantly reduce the fatigue of the wrist when the rotating mode is set to perform the cleaning even in a case in which the cleaning for a window frame, a sofa, a ceiling, and the like in addition to a general floor is performed.

Meanwhile, in the embodiment, it has been described that the extension tube having the suction nozzle is connected to the handy-stick type vacuum cleaner to use the handy-stick type vacuum cleaner, but instead of the extension tube having the suction nozzle, various types of cleaner accessories may be connected to the handy-stick type vacuum cleaner to use the handy-stick type vacuum cleaner.

Although the embodiments of the disclosure are illustrated and described hereinabove, the disclosure is not limited to the abovementioned specific embodiments, but may be variously modified by those skilled in the art to which the disclosure pertains without departing from the scope and spirit of the disclosure claimed in the claims. These modifications should also be understood to fall within the scope of the disclosure.

The invention claimed is:

1. A handy-stick type vacuum cleaner comprising:

a first part configured to include a dust collection unit;

a second part configured to include a suction motor and a handle;

a third part configured to rotatably connect the first and second parts with each other; and a mode setting unit configured to be disposed inside the second part to selectively lock and unlock the third part, and set a rotating mode in which the first and second parts are rotated with respect to each other and a fixing mode in which the first and second parts are not rotated with respect to each other, wherein the third part includes:

a first connection member coupled to the first part; and a second connection member coupled to the second part and rotatably connected to the first connection member.

2. The handy-stick type vacuum cleaner as claimed in claim 1, wherein the mode setting unit includes a locking protrusion moving to any one of a locked position and an unlocked position for locking and unlocking the first connection member, and wherein the first connection member includes an engaging protrusion that interferes with the locking protrusion at the locked position.

3. The handy-stick type vacuum cleaner as claimed in claim 2, wherein the mode setting unit includes:

a button having a portion protruding externally from the second part;

a holder fixed to the inside of the second part; and a latch having one side coupled to the button and the other side movably connected to the holder, and formed integrally with the locking protrusion.

4. The handy-stick type vacuum cleaner as claimed in claim 3, wherein an elastic member for elastically supporting the latch is disposed inside the holder.

5. The handy-stick type vacuum cleaner as claimed in claim 3, wherein the second part is formed with the handle and the button is disposed at a position adjacent to the handle.

6. The handy-stick type vacuum cleaner as claimed in claim 2, wherein each of the locking protrusion and the engaging protrusion has one side surface disposed in a direction facing each other in the fixing mode and the other side surface disposed on an opposite side to the one side surface, and wherein at least one of the other side surface of the locking protrusion or the other side surface of the engaging protrusion is formed to be inclined.

7. The handy-stick type vacuum cleaner as claimed in claim 2, wherein the second connection member is formed with an accommodation space in which a rear of the first connection member is rotatably accommodated, and wherein the locking protrusion is led into the accommodation space to interfere with the engaging protrusion of the first connection member.

8. The handy-stick type vacuum cleaner as claimed in claim 1, wherein in the fixing mode, an axis of the first part in a length direction and an axis of the second part in a length direction are in parallel to each other, and wherein in the rotating mode, the axis of the first part in the length direction and the axis of the second part in the length direction form an obtuse angle.

9. The handy-stick type vacuum cleaner as claimed in claim 1, wherein the first and second parts communicate with each other through a flexible tube.

10. The handy-stick type vacuum cleaner as claimed in claim 9, wherein the flexible tube is disposed inside the third part.

11. The handy-stick type vacuum cleaner as claimed in claim 1, wherein an angle at which the first part is rotatable with respect to the second part is an acute or obtuse angle.

12. A handy-stick type vacuum cleaner comprising:

a first part having a connection pipe formed in a tip thereof and configured to include a dust collection unit having a suction hole and detachably mounted in a mounting space such that the suction hole is communicating with the connection pipe;

a second part configured to have a suction motor disposed inside thereof and a handle extending to one side thereof, and communicate with the first part through a flexible tube;

a third part configured to rotatably connect the first and second parts with each other, the third part including:

a first connection member coupled to a rear of the first part, and a second connection member coupled to a front of the second part and rotatably connected to the first connection member by a rotation shaft; and a mode setting unit configured to set a rotating mode in which the first part is rotated and a fixing mode in which the first part is not rotated by selectively locking and unlocking the first part, wherein the mode setting unit is elastically disposed in a state movable inside the second part, has a portion protruding externally from the second part, and interferes with a portion of the third part in the fixing mode.

13. The handy-stick type vacuum cleaner as claimed in claim 12, wherein the mode setting unit includes a locking protrusion for locking and unlocking an engaging protrusion of the first part, wherein each of the locking protrusion and the engaging protrusion has one side surface disposed in a direction facing each other in the fixing mode and the other side surface disposed to be inclined on an opposite side to the one side surface, and wherein the other side surfaces of the locking protrusion and the engaging protrusion are inclined in a direction facing each other.

* * * * *